US008485860B2

(12) United States Patent
Oliver et al.

(10) Patent No.: US 8,485,860 B2
(45) Date of Patent: Jul. 16, 2013

(54) ABRASIVE PRODUCTS WITH SPLICE MARKS AND AUTOMATED SPLICE DETECTION

(75) Inventors: Christophe C. Oliver, Dover, MA (US); Lionel Rossignol, Saratoga Springs, NY (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 1115 days.

(21) Appl. No.: 12/220,313

(22) Filed: Jul. 22, 2008

(65) Prior Publication Data

US 2009/0029628 A1 Jan. 29, 2009

Related U.S. Application Data

(60) Provisional application No. 60/994,744, filed on Sep. 21, 2007, provisional application No. 60/962,278, filed on Jul. 27, 2007.

(51) Int. Cl.

| | |
|---|---|
| ***B24B 1/00*** | (2006.01) |
| ***B24B 49/00*** | (2012.01) |
| ***B24B 51/00*** | (2006.01) |
| ***B24D 11/00*** | (2006.01) |

(52) U.S. Cl.

USPC ..... 451/5; 451/9; 451/10; 451/531

(58) Field of Classification Search

USPC ..... 51/295, 293; 451/5, 57, 66, 527, 451/529, 531, 539, 8, 9, 10, 11, 59; 382/152

See application file for complete search history.

(56) References Cited

U.S. PATENT DOCUMENTS 2,215,210 A * 9/1940 Dahlstrom ..... 451/531
2,391,731 A * 12/1945 Miller et al. ..... 451/531

(Continued)

FOREIGN PATENT DOCUMENTS

DE 1874395 U 6/1963
DE 6602023 U 4/1969

(Continued)

OTHER PUBLICATIONS

International Search Report for International Application No. PCT/US2008/070745 dated Oct. 28, 2008.

(Continued)

*Primary Examiner* — Timothy V Eley
(74) *Attorney, Agent, or Firm* — Joseph P. Sullivan; Abel Law Group, LLP

(57) ABSTRACT

A coated abrasive product, comprising a first section and a second section, the first and the second sections being continuously joined together by a splice. The first section includes at least one first splice mark adjacent to the splice, wherein the first splice mark is a marking or a cluster of markings. A method of processing an article with such a coated abrasive product, and a method of acquiring information of such a coated abrasive product, respectively, includes detecting at least one characteristic of at least one first splice mark of the first section of the abrasive product, and comparing the detected characteristic to a database, wherein the detected characteristic of the first splice mark conveys approach of the splice and the end of the first section. The method of processing an article further includes providing a signal to skip the splice to thereby prevent the article being processed with splice area of the abrasive product. A method of preparing such a coated abrasive product includes forming the first and the second sections of the abrasive product.

53 Claims, 9 Drawing Sheets

U.S. PATENT DOCUMENTS

| | | | | | |
|---|---|---|---|---|---|
| 2,733,181 | A | * | 1/1956 | Riedesel | 51/293 |
| 3,053,020 | A | * | 9/1962 | Bratton | 451/531 |
| 3,154,897 | A | * | 11/1964 | Howard | 451/531 |
| 3,427,765 | A | * | 2/1969 | McGarvey | 451/531 |
| 3,564,782 | A | * | 2/1971 | Haywood | 451/531 |
| 3,729,873 | A | * | 5/1973 | Sandell | 451/531 |
| 3,872,629 | A | * | 3/1975 | Malloy | 51/295 |
| 4,024,302 | A | * | 5/1977 | Takagi et al. | 427/290 |
| 5,424,762 | A | | 6/1995 | Higashi et al. | |
| 5,470,362 | A | | 11/1995 | Gorsuch et al. | |
| 5,575,873 | A | * | 11/1996 | Pieper et al. | 156/153 |
| 5,951,383 | A | * | 9/1999 | Eisenblaetter | 451/296 |
| 5,967,394 | A | | 10/1999 | Crowley et al. | |
| 6,264,533 | B1 | * | 7/2001 | Kummeth et al. | 451/8 |
| 6,287,184 | B1 | | 9/2001 | Carpentier et al. | |
| 6,520,080 | B1 | | 2/2003 | Fried | |
| 6,616,513 | B1 | | 9/2003 | Osterheld et al. | |
| 6,627,024 | B2 | * | 9/2003 | Lane | 156/157 |
| 7,052,426 | B2 | * | 5/2006 | Battat et al. | 474/253 |
| 7,326,330 | B2 | | 2/2008 | Herrington et al. | |
| 2001/0039076 | A1 | | 11/2001 | Hashimoto | |
| 2005/0085167 | A1 | | 4/2005 | Swei et al. | |
| 2007/0144677 | A1 | * | 6/2007 | Rawlings | 156/502 |
| 2009/0036027 | A1 | | 2/2009 | Rossignol et al. | |

FOREIGN PATENT DOCUMENTS

| | | | |
|---|---|---|---|
| DE | 41 11 016 | C1 | 7/1992 |
| DE | 69305206 | T2 | 2/1997 |
| DE | 202004021051 | | 7/2006 |
| EP | 0529833 | A1 | 8/1992 |
| JP | 07108742 | | 4/1995 |
| JP | 07108743 | | 4/1995 |
| JP | 2005345359 | | 12/2005 |
| WO | WO 00/73020 | A1 | 12/2000 |
| WO | WO 02/062531 | A1 | 8/2002 |

OTHER PUBLICATIONS

International Search Report for International Application No. PCT/US2008/070746 dated Oct. 28, 2008.

Written Opinion of the International Searching Authority, International Application No. PCT/US2008/070745, Date of Mailing: Oct. 28, 2008.

Written Opinion of the International Searching Authority, International Application No. PCT/US2008/07046, Date of Mailing: Oct. 28, 2008.

International Preliminary Report on Patentability, International Application No. PCT/US2008/070746, Date of Issuance: Feb. 2, 2010.

International Preliminary Report on Patentability, International Application No. PCT/US2008/070745, Date of Issuance: Feb. 2, 2010.

Universal Product Code, Universal Product Code—Wikipedia, the free encyclopedia [online], Jun. 2007 [retrieved on Jun. 15, 2007]. Retrieved from the Internet URL: http://en.wikipedia.org/wiki/UPC_bar_code.

* cited by examiner

ABRASIVE PRODUCTS WITH SPLICE MARKS AND AUTOMATED SPLICE DETECTION

RELATED APPLICATIONS

This utility application claims the benefit of U.S. Provisional Application No. 60/994,744, filed on Sep. 21, 2007, and U.S. Provisional Application No. 60/962,278, filed on Jul. 27, 2007, the entire teachings of which are incorporated herein by reference.

BACKGROUND OF THE INVENTION

Various types of automated processing systems have been developed to abrasively process articles of various compositions and configurations. For example, coated abrasive strips, rolls or tapes, fed from automatic abrasive feed machines are employed to process parts, such as automobile and powertrain parts (e.g., crankshaft, camshaft, transmission shaft, steering shaft, steering rod). Although conventional automatic abrasive feed machinery systems provide some degree of automation, certain aspects remain manual, and are prone to error, such as proper loading of rolls of abrasive onto feed machines, including the type of abrasive for the part to be processed, and orientation of the roll. Manual examination and verification is time consuming and costly. Errors caused by operators can have very deleterious results, resulting in significant waste during manufacture. In addition, conventional micro-finishing film rolls are generally limited to continuous rolls, because splices are not typically acceptable for processing an article, and are not readily identifiable automatically. Generally, such continuous micro-finishing film rolls do not exceed 1,600 feet due to the challenges associated with coating evenly for long runs.

Therefore, there is a need for methods of detecting a splice joining two different sections of a coated abrasive product, in particular, fed from an automatic abrasive feed machine during processing of an article, which can reduce or eliminate one or more of the above-mentioned problems.

SUMMARY OF THE INVENTION

The present invention generally relates to a coated abrasive product comprising a first section and a second section, which are continuously joined together by a splice, to a method of processing an article with such a coated abrasive product, to a method of acquiring information of such a coated abrasive product, and to a method of preparing such a coated abrasive product.

In one embodiment, the present invention is directed to a coated abrasive product that comprises a first section and a second section, the first and the second sections being continuously joined together by a splice. The first section includes at least one first splice mark adjacent to the splice, wherein the first splice mark is a marking or a cluster of markings.

In another embodiment, the present invention is directed to a method of processing an article with a coated abrasive product. The method includes detecting at least one characteristic of at least one first splice mark of a first section of the abrasive product, wherein the abrasive product further includes a second section that is continuously joined together with the first section by a splice. The first splice mark is placed adjacent to the splice, and is a marking or a cluster of markings. The method further includes comparing the detected characteristic to a database, wherein the detected characteristic of the first splice mark conveys approach of the splice and the end of the first section. The method further includes providing a signal to skip the splice to thereby prevent the article being processed with the splice area of the abrasive product.

In yet another embodiment, the present invention is directed to a method of acquiring information of a coated abrasive product. The method includes detecting at least one characteristic of at least one first splice mark of a first section of the abrasive product, wherein the abrasive product further includes a second section that is continuously joined together with the first section by a splice. The first splice mark is placed adjacent to the splice, and is a marking or a cluster of markings. The method further includes comparing the detected characteristic to a database, wherein the detected characteristic of the first splice mark conveys approach of the splice and the end of the first section.

In yet another embodiment, the present invention is directed to a method of preparing a coated abrasive product. The method includes a first section and a second section of the abrasive product, wherein the first and the second sections are continuously joined together by a splice. The first section includes at least one first splice mark adjacent to the splice, the first splice mark being a marking or a cluster of markings.

In a coated abrasive product of the invention, having a plurality of sections which are continuously joined together with each other by a splice, such splice can be detected and skipped automatically from being employed for processing an article. Thus, with the invention, film rolls much longer than conventional ones can be readily used for processing an article, such as micro-finishing or sanding. In addition, the use of multiple sections which are continuously joined together with a splice can offer cost saving benefits due, at least in part, to less frequent changeovers of abrasive products for processing an article.

DETAILED DESCRIPTION OF THE INVENTION

Figure 1:
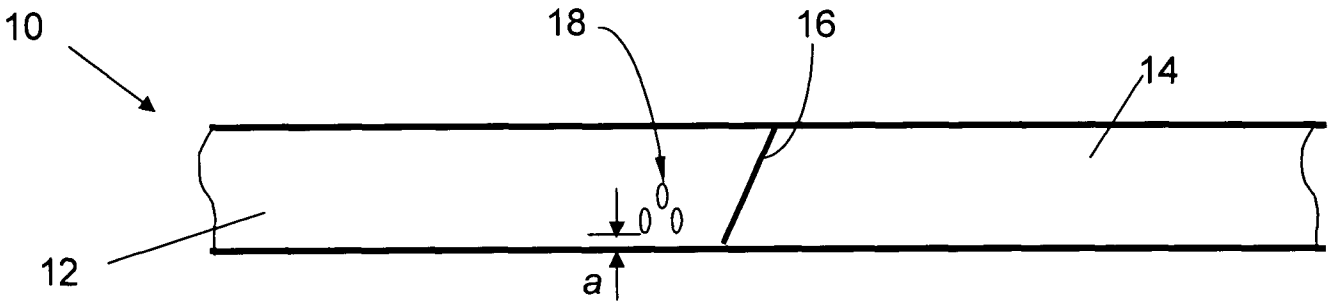
FIG. 1 is a schematic drawing showing one embodiment of a coated abrasive product of the invention.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

The present invention generally relates to a coated abrasive product comprising a first section and a second section, which are continuously joined together by a splice, to a method of processing an article with such a coated abrasive product, to a method of acquiring information of such a coated abrasive product, and to a method of preparing such a coated abrasive product. Examples of articles suitable for processing by the coated abrasive products and methods of the invention include parts of an automobile and powertrain parts, such as crankshafts, camshafts, transmission shafts, steering shafts and steering rods.

A coated abrasive product of the invention employs one or more splice marks placed adjacent to a splice joining two separate sections continuously. Optionally, the coated abrasive product can further include at least one section mark in at least one of the sections. The section mark can be placed adjacent to the beginning of the section, or alternatively essentially throughout the length of each section. As used herein, the term "adjacent to a splice" means within about 10%, in distance, of the length of each section from the splice. As used herein, the term "adjacent to the beginning" of a section means within about 10%, in distance, of the length of each section from the beginning of the section. In some embodiments, the splice mark(s) are placed within about 5% or within about 1%, in distance, of the length of each section from the splice. In some embodiments, the beginning section mark(s) are placed within about 5% or within about 1%, in distance, of the length of each section from the beginning of the section. As used herein, "essentially throughout the length" of each section means throughout at least about 50% of the length of the section. When the section marks are placed throughout the length of the section, in some embodiments, the marks are placed throughout at least about 75%, at least about 90%, or at least about 95%, of the length of the section.

In a first embodiment, a coated abrasive product of the invention includes a first section and a second section which are continuously joined together by a splice, wherein the first section includes at least one first splice mark adjacent to the splice. FIG. 1 shows abrasive product 10, an embodiment of the coated abrasive product of the invention. As shown in the figure, abrasive product 10 includes first section 12 and second section 14. First and second sections 12 and 14 are continuously joined together by splice 16. First section 12 includes first splice mark 18. As shown in FIG. 1, first splice mark 18 can be a cluster of markings. Alternatively, first splice mark 18 can be a marking. Although one first splice mark 18 is shown in FIG. 1, a plurality of first splice marks 18 can be employed in the invention across the width of the abrasive product. The coated abrasive products of the invention generally include abrasive grains, either in powder form or in agglomerate form of abrasive powders, and a binder over a substrate (or a base layer), and optionally further includes one or more coatings over the abrasive grains. In the preferred embodiments, the markings or cluster of markings suitable for use in the invention are not abrasive grains.

At least one characteristic of first splice mark 18 conveys approach of splice 16 and the end of first section 12. Examples of the characteristic include shape of the marking, dimension of the marking, color of the marking, number of the markings, distance of the mark from an edge along the length of the abrasive product, distance between the markings, and shape of the marking cluster. Additional examples of the characteristic include the number of the first splice marks across the width of the coated abrasive product and the distance between the first splice marks.

Figure 2:
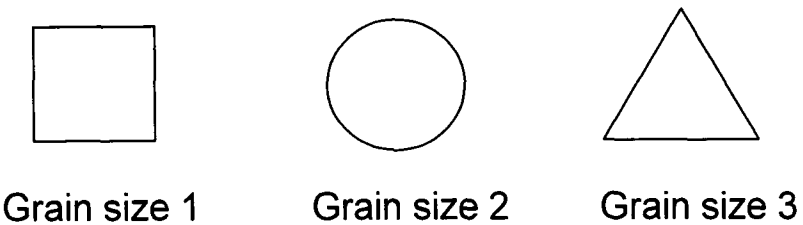
FIG. 2 is a schematic drawing showing various types of markings that can be employed in the invention.

In a specific embodiment, first splice mark 18 further includes at least one characteristic that conveys identification information of second section 14 of abrasive product 10. Examples of the characteristics are as described above for the characteristics conveying the approach of splice 16 and the end of first section 12. One or more of these characteristics convey information regarding abrasive characteristic of first section 12, including identification information (e.g., product type, grain size, width, manufacturer, etc.) and process needs (e.g., abrasive side identification, index, rupture or breakage of the abrasive product, end of the abrasive product, etc.) for processing an article. In one example of this embodiment, the shape of the marking(s) of first splice mark 18 e.g., an oval shape, can indicate the grain size of the abrasive grains of second section 14, for example, grain size 1, grain size 2, or grain size 3, as shown in FIG. 2. In another example, the shape of the marking(s) of first splice mark 18, e.g., an oval shape, can indicate the grain size of the abrasive grains of second section 14, while the number of the marking(s) of first splice mark 18, or the distance of first splice mark 18 from an edge along the length of abrasive product 10 (e.g., distance "a" shown in FIG. 1), or the number of first splice marks 18 across the width of abrasive product 10 (not shown in FIG. 1) can indicate the approach of splice 16 and the end of first section 12. Various other combinations of characteristics of first splice marks 18 can be employed in the invention to convey the approach of splice 16 and the end of first section 12, and to further convey identification information of second section 14 of abrasive product 10.

Figure 3A:
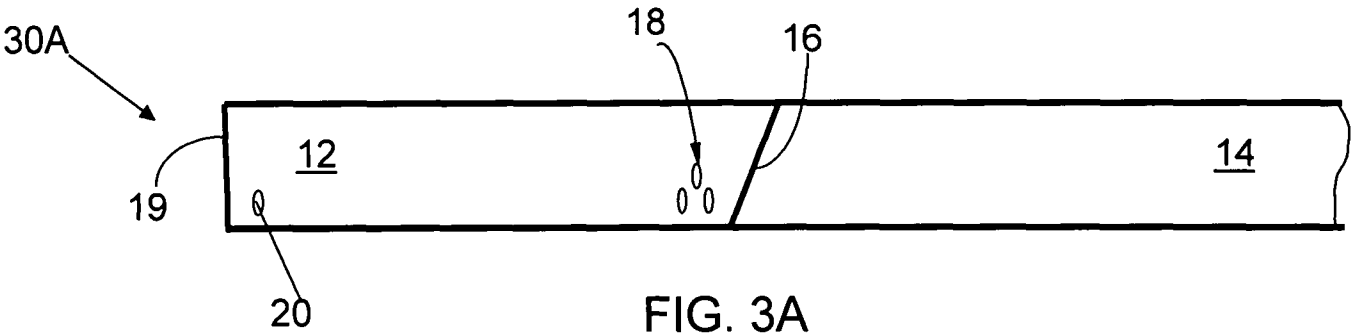
FIGS. 3A and 3B are schematic drawings showing two embodiments of a coated abrasive product of the invention.
Figure 3B:
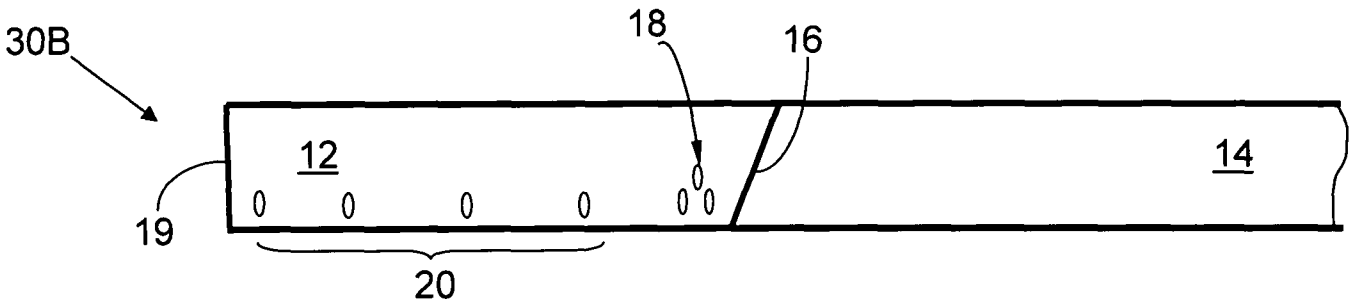

In a second embodiment, the coated abrasive products of the invention further include at least one first section mark 20 adjacent to beginning 19 of first section 12, as in abrasive product 30A of FIG. 3A and abrasive product 30B of FIG. 3B. As shown in FIGS. 3A and 3B, first section mark 20 can be a marking. Alternatively, first section mark 20 can be a cluster of markings. In a specific embodiment, a repeat of first section marks 20 is employed, and the repeat extends essentially throughout the length of first section 12, as shown in FIG. 3B. The repeat of first section marks 20 can be non-periodic. Alternatively, the repeat of first section marks 20 can be periodic. In one example of such non-periodic repeat of first section marks 20, the distance between marks 20 is incrementally increased from the beginning to the end of the repeat. The increment can be regular, such as the distance between markings $\mathbf{12}a_i$ and $\mathbf{12}a_{i+l}$ is a factor longer (e.g., 1.5×, or 2×, or 3×, etc.) than the distance between markings $\mathbf{12}a_i$ and $\mathbf{12}a_{i-l}$. Alternatively, the increment can be irregular. Characteristics, including specific characteristics of the marking(s) of first section mark 20 are as described above for first splice mark 18, such as shape, dimension, color, number of the markings and distance between the markings. In addition to these characteristics of each marking of first section mark 20, additional characteristics of first section mark 20 includes distance of the mark from an edge along the length of the abrasive product, and shape of the marking cluster. When a repeat of first section marks 20 is employed, distance between first section marks 20 can contribute as an additional characteristic of first section marks 20.

First section mark 20 can share at least one characteristic with first splice mark 18. Examples of the characteristic include shape of the marking, dimension of the marking, color of the marking, number of the markings, distance of the mark from an edge along the length of the abrasive product, distance between the markings, and shape of the marking cluster. In a specific embodiment, first section mark 20 at the beginning of first section 12, and first splice mark 18 are the same, and the distance between the first section mark 20 adjacent to the beginning of first section 12 and the first splice mark 18 (e.g., by counting the number of first section marks 20 when a repeat of first section marks 20 is employed, or by detecting a period of time between the first section mark(s) 20 adjacent to the beginning of first section 12, and first splice mark 18) conveys approach of splice 16 and the end of first section 12. Alternatively, first section mark 20 and first splice mark 18 can have at least one characteristic different from each other, as shown in FIGS. 3A and 3B. In one example of abrasive product 30 (collectively referring to abrasive products 30A and 30 B) of FIGS. 3A and 3B, the shape of the marking of first section mark 20, or the distance of first section mark 20 from an edge along the length of abrasive product 20, or the distance between first section markings 20 (e.g., see FIG. 3B) convey at least one abrasive characteristic of first section 12. In this example, at the same time, the shape of the cluster of markings of first splice mark 18, or the number of markings of first splice mark 18 conveys the approach of splice 16 and the end of first section 12.

Optionally, in an abrasive product that employs first splice mark 18 and first section mark 20, such as abrasive products 30 of FIGS. 3A and 3B, at least one characteristic of first splice mark 18 can further conveys information regarding abrasive characteristic of second section 14, as described above for abrasive product 10 of FIG. 1. For example, in abrasive product 30 of FIGS. 3A and 3B, the shape of the marking of first section mark 20, or the distance of first section mark 20 from an edge along the length of abrasive product 20, or the distance between first section markings 20 (e.g., see FIG. 3B) conveys at least one abrasive characteristic of first section 12. In this example, at the same time, the shape of the cluster of markings of first splice mark 18 conveys the approach of splice 16 and the end of first section 12, and the number of markings of first splice mark 18 conveys information regarding abrasive characteristic of second section 14, or vice versa.

In a third embodiment, a coated abrasive product of the invention, for example, abrasive product 10 or 30, further includes at least one second splice mark 22 adjacent to splice 16 in second section 14. FIGS. 4A-4K show abrasive products 40 (collectively referring to abrasive products 40A-40K) employing second splice mark 22. Second splice mark 22 can be a cluster of markings. Alternatively, second splice mark 22 can be a marking. Characteristics, including specific characteristics, of second splice mark 22 are as described above for first splice mark 18.

In one specific embodiment employing both first and second splice marks 18 and 22, first splice mark 18 and second splice mark 22 have at least one characteristic different from each other. Examples of the at least one different characteristic include shape of the marking, dimension of the marking, color of the marking, number of the markings, distance of the mark from an edge along the length of the abrasive product, distance between the markings, and shape of the marking cluster. Additional examples of the at least one different characteristic include the number of the splice marks across the width of the coated abrasive product and the distance between the splice marks. For example, first splice mark 18 and second splice mark 22 in abrasive product 40A of FIG. 4A have different cluster shapes. In another example, first splice mark 18 and second splice mark 22 in abrasive product 40B of FIG. 4B have different numbers of splice marks across the width of abrasive product 40B. In yet another example, first splice mark 18 and second splice mark 22 in abrasive product 40C of FIG. 4C have different shape of splice marks and different number of splice marks across the width of abrasive product 40C.

In another specific embodiment employing both first and second splice marks 16 and 22, at least one characteristic of second splice mark 22 conveys the beginning of second section 14. In one, more specific embodiment, at least one characteristic of second splice mark 22 conveys the beginning of second section 14, and further conveys at least one piece of abrasive characteristics (or abrasive product information) of second section 14, such as product type, grain size, identification of abrasive side, width and index. In another, more specific embodiment, at least one characteristic of second splice mark 22 conveys the beginning of second section 14, and further conveys whether second section 14 of the abrasive product has the correct abrasive characteristic for an article to be processed.

Figure 4A:
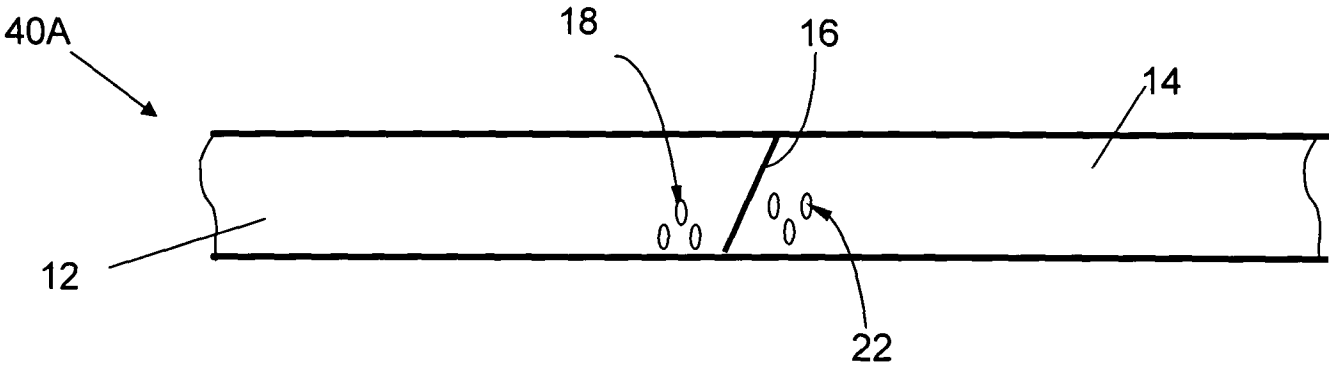
FIGS. 4A-4K are schematic drawings showing other embodiments of a coated abrasive product of the invention.
Figure 4B:
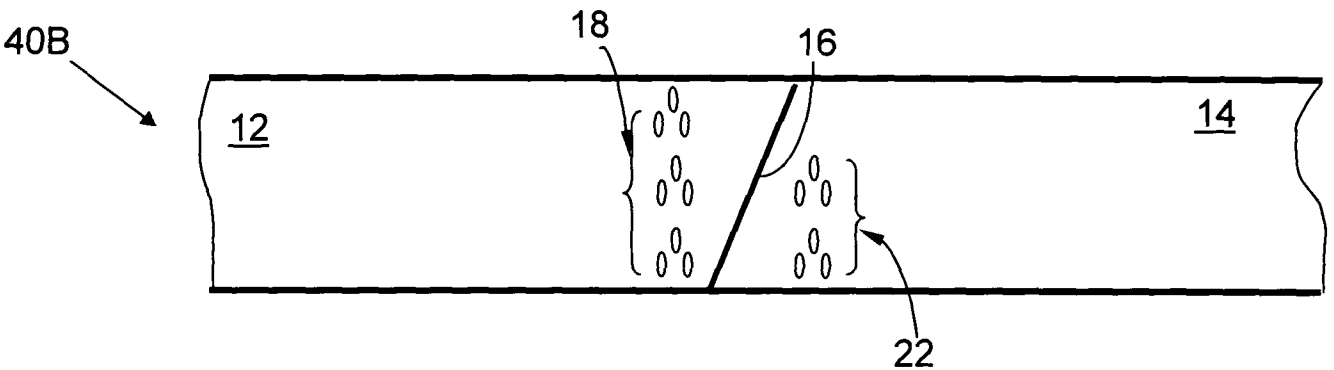
Figure 4C:
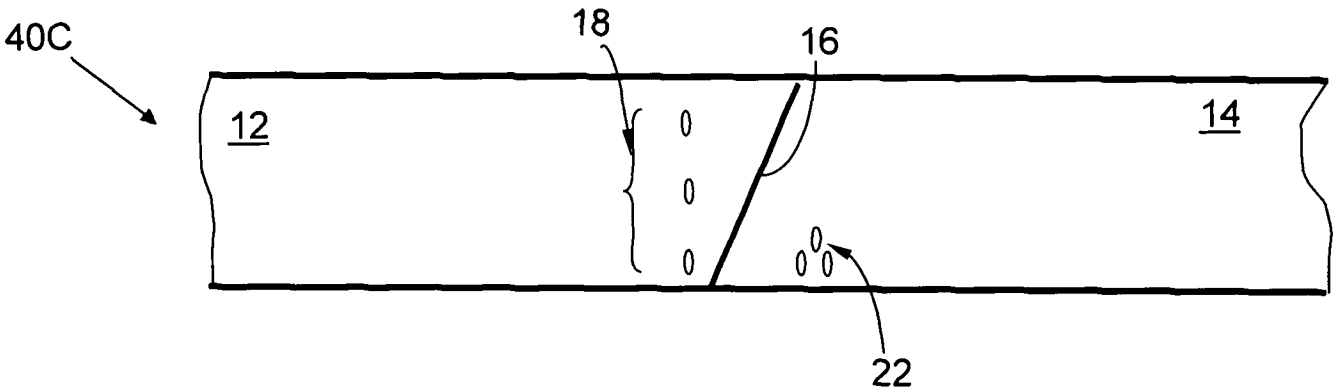
Figure 4D:
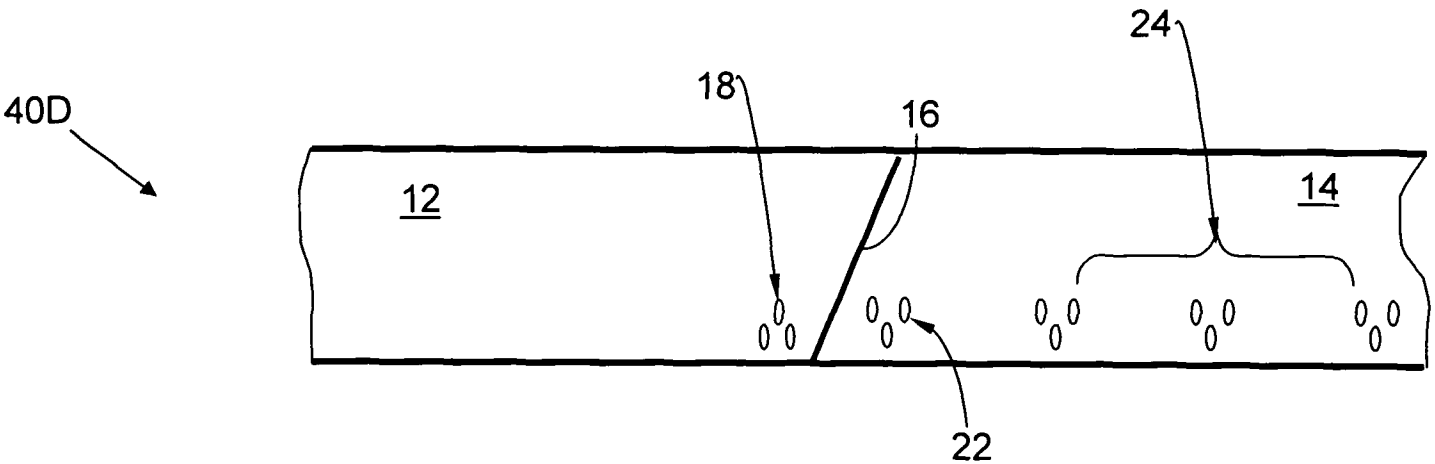

In a fourth embodiment, a coated abrasive product of the invention employs both first and second splice marks 18 and 22 adjacent to splice 16, and further includes at least one second section mark 24 at an area other than adjacent to splice 16 of second section 14. Second section mark 24 can be a marking, or alternatively, a cluster of markings. In this embodiment, second splice marks 22 and second section mark 24 can share at least one common characteristic with each other, or alternatively, can share at least one different characteristic with each other. In one specific embodiment, second splice marks 22 and second section mark 24 are the same, as shown in FIG. 4D. In another specific embodiment, a repeat of second section marks is employed as shown in FIG. 4D, and the second section mark repeat extends essentially throughout the length of second section 14. The repeat of second section marks 24 can be non-periodic or periodic, as described above for the repeat of first section marks 20. Characteristics, including specific characteristics, of the marking(s) of second section mark 24 are as described above for first section mark 20, including shape, dimension, color and number of the markings, distance between the markings, distance of the mark from an edge along the length of the abrasive product, shape of the marking cluster, and distance between marks.

Figure 4E:
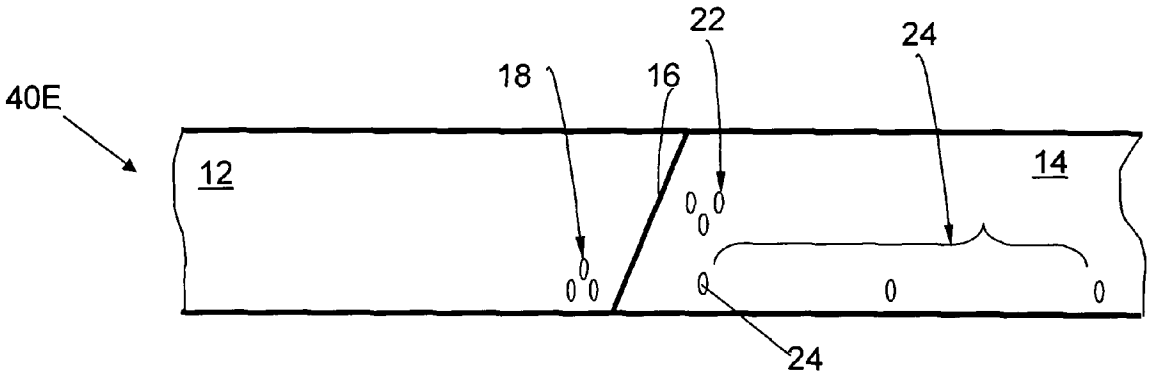
Figure 4F:
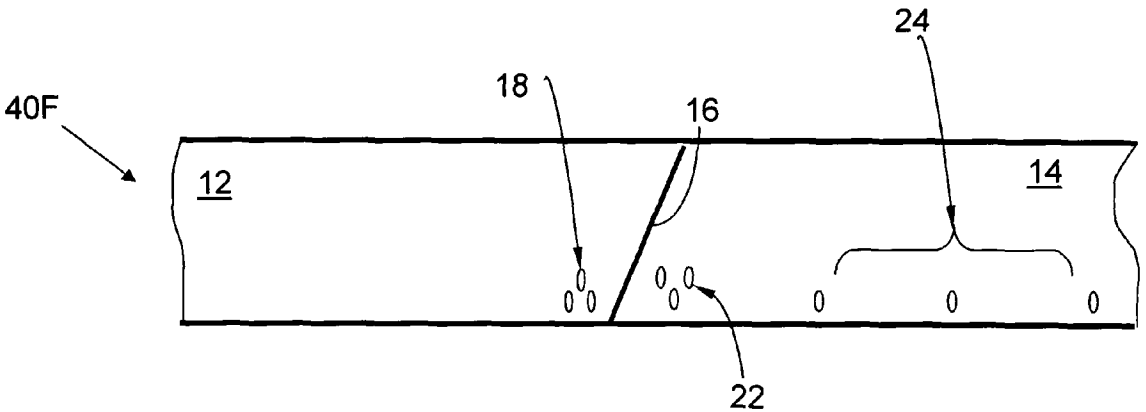

In a fifth embodiment, a coated abrasive product of the invention employs both first and second splice marks 18 and 22 adjacent to splice 16, and further includes at least one second section mark 24, wherein second section mark 24 and second splice mark 22 have at least one characteristic different from each other, as shown in FIGS. 4E and 4F. The at least one different characteristic is selected from the group consisting of shape of the marking, dimension of the marking, color of the marking, number of the markings, distance of the mark from an edge along the length of abrasive product, distance between the markings, and shape of the marking cluster. Characteristics, including specific characteristics, of second section mark 24 are as described above. In one specific embodiment, a repeat of second section marks 24 extending essentially throughout the length of second section 14 is employed, as shown in FIGS. 4E and 4F. The repeat of second section marks 24 can be non-periodic, or alternatively, the repeat of second section marks 24 can be periodic, as described above for the repeat of first section marks 20.

In one specific embodiment, at least one characteristic of second section mark 24 conveys information regarding second section 14 of, for example, abrasive product 40 (collectively referring to abrasive products 40E and 4F of FIGS. 4E and 4F). Examples of the characteristic include shape of the marking, dimension of the marking, color of the marking, number of the markings, distance of the mark from an edge along the length of the abrasive product, distance between the markings, and shape of the marking cluster. One or more of these characteristics convey information regarding abrasive characteristic of second section 14, including identification information (e.g., product type, grain size, width, manufacturer, etc.) and process needs (e.g., abrasive side identification, index, rupture or breakage of the abrasive product, end of the abrasive product, etc.) for processing an article. For example, the shape of the marking(s) of second section mark 24, e.g., an oval shape, can indicate the grain size of the abrasive of second section 14. In another example, the shape of the marking, e.g., an oval shape, can indicate the manufacturer of the abrasive product, while the number of the markings of second section mark 24, or the distance of second section mark 24 from an edge along the length of abrasive product 40 can indicate the grain size of abrasive grains of second section 14.

In yet another specific embodiment, second section mark 24 can be located adjacent to splice 16 together with second splice mark 22, as shown in FIG. 4E. Alternatively, second section mark 24 can be located at an area other than adjacent to splice 16, as shown in FIG. 4F.

Figure 4G:
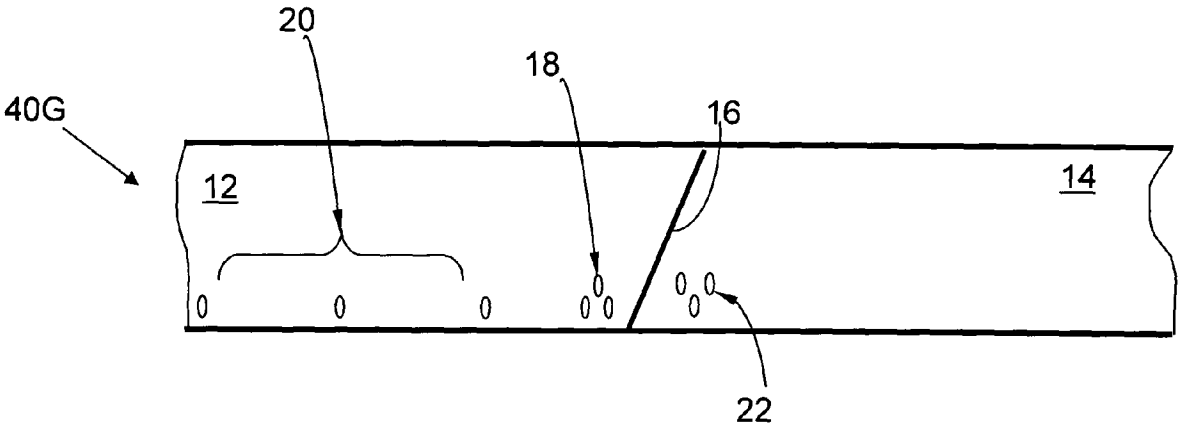
Figure 4H:
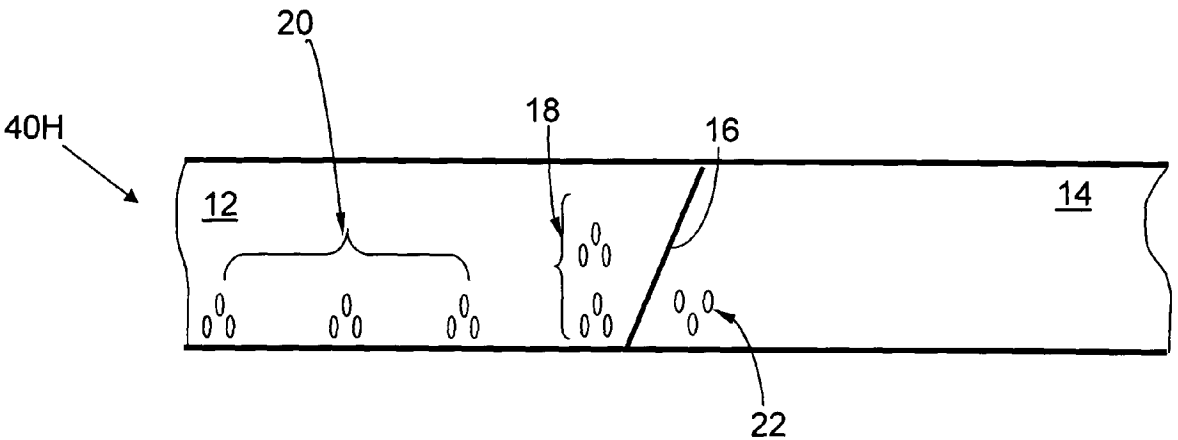
Figure 4I:
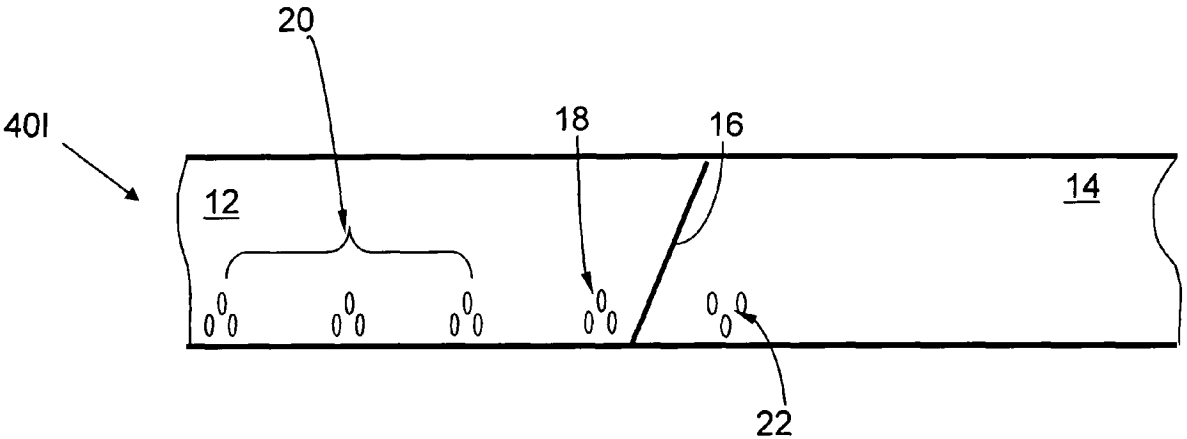

In a sixth embodiment, a coated abrasive product of the invention employs both first and second splice marks 18 and 22 adjacent to splice 16, and further includes at least one of first section mark 20 adjacent to the beginning of first section 12, wherein features, including specific features, of each of the marks are as described above. FIGS. 4G-4I show abrasive products 40G-40I of certain such embodiments.

In one specific embodiment of the sixth embodiment, first section mark 20 shares at least one characteristic with at least one of first splice mark 18 and second splice mark 22. The at least one common characteristic is selected from the group consisting of shape of the marking, dimension of the marking, color of the marking, number of the markings, distance of the mark from an edge along the length of abrasive product, distance between the markings, and shape of the marking cluster. In another specific embodiment of the fifth embodiment, first section mark 20 and first splice mark 18 have at least one characteristic different from each other. The at least one different characteristic is selected from the group consisting of shape of the marking, dimension of the marking, color of the marking, number of the markings, distance of the mark from an edge along the length of abrasive product, distance between the markings, and shape of the marking cluster.

Figure 4J:
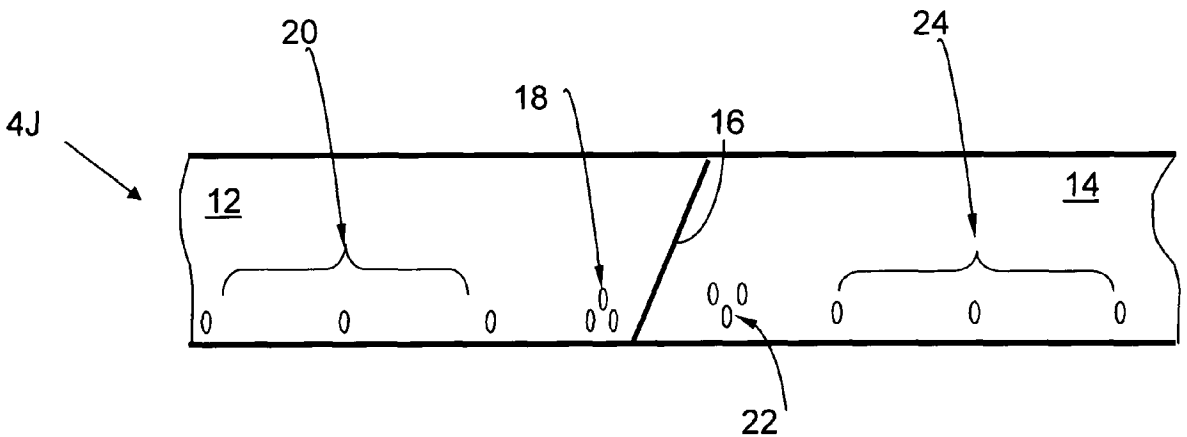
Figure 4K:
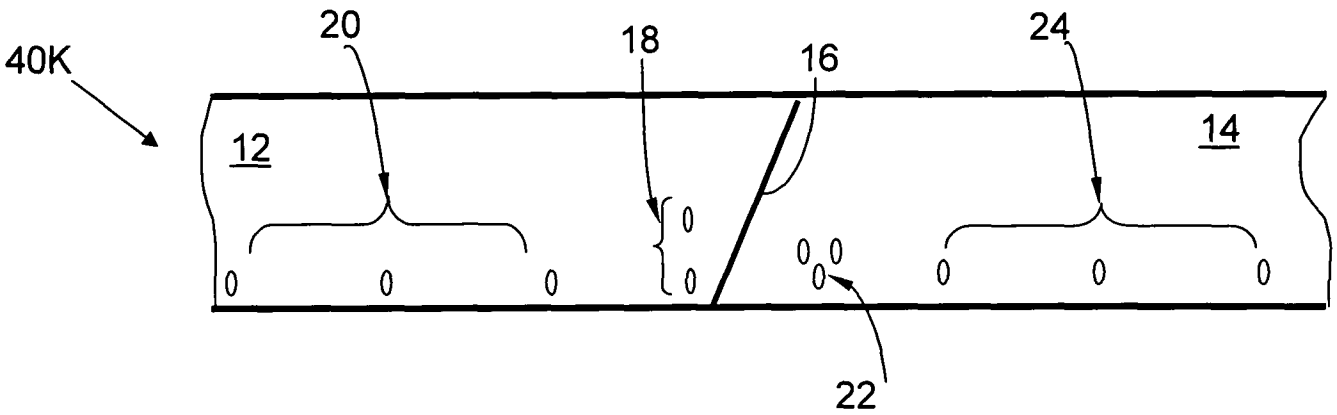

In a seventh embodiment, a coated abrasive product of the invention employs both first and second splice marks 18 and 22 adjacent to splice 16, further includes at least one of first section mark 20 adjacent to the beginning of first section 12, and further includes at least one second section mark 24, wherein features, including specific features, of each of the marks are as described above. FIGS. 4J and 4K show abrasive products 40J and 40K of certain such embodiments.

Figure 5:
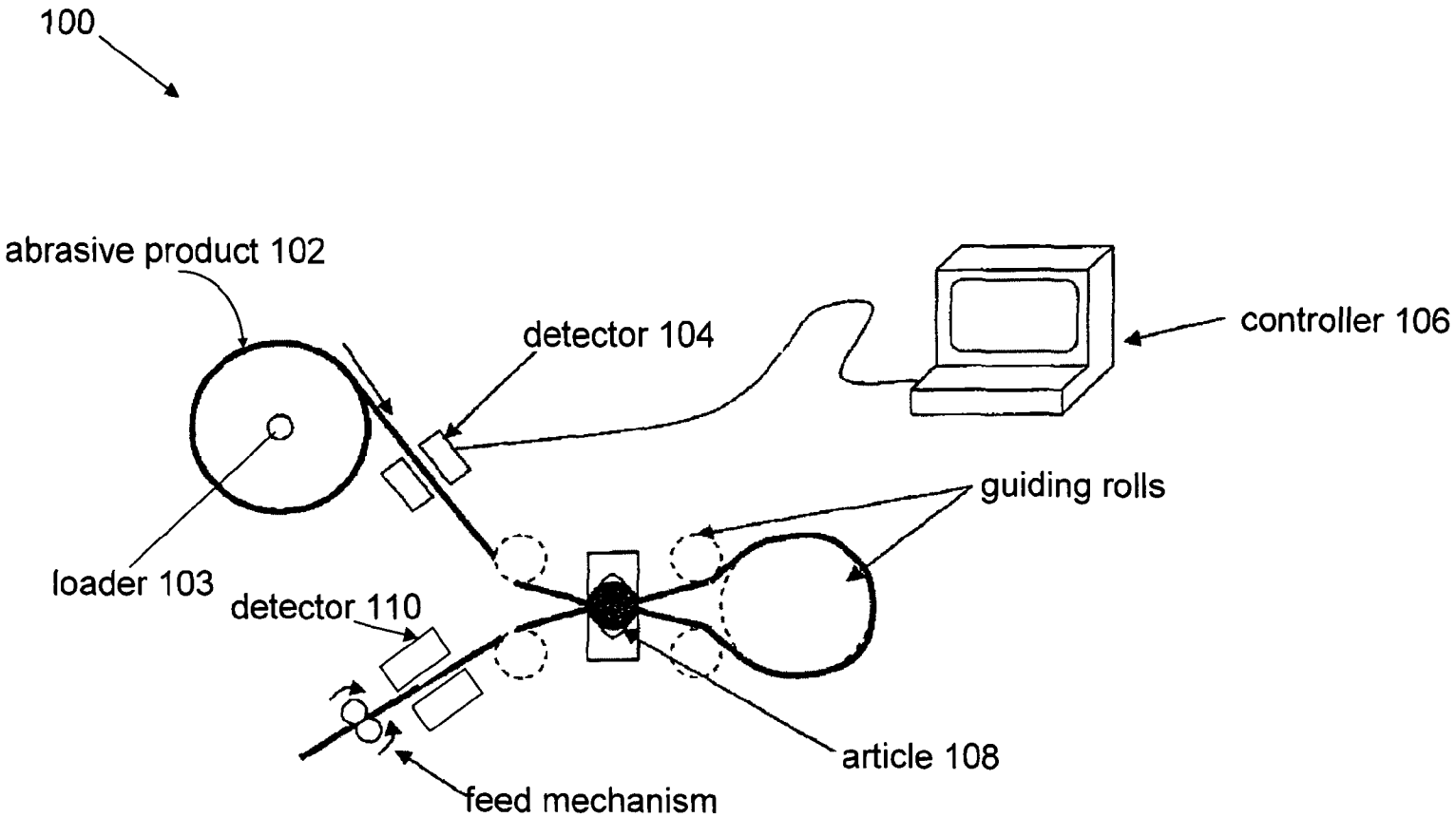
FIG. 5 is a schematic drawing showing a processing system by which a method of the invention can be employed.

The present invention also encompasses a method of processing an article with a coated abrasive product of the invention disclosed herein, and a method of acquiring information of a coated abrasive product of the invention disclosed herein. Also, encompassed in the invention is an automatic processing system, wherein an article is automatically processed with a coated abrasive product of the invention disclosed herein. FIG. 5 shows automatic processing system 100 where abrasive product 102 (collectively referring to the abrasive products of the invention, including abrasive products 10, 30 and 40) is loaded at loader 103 for processing an article 108, such as a part of an automobile, or a powertrain part (e.g., crankshaft, camshaft, transmission shaft, steering shaft, steering rod). Features of abrasive product 102 of the invention, including specific features, are as described above. Characteristics of first and/or splice marks 18 and 22, and optionally first and/or second section marks 20 and 24, of abrasive product 102 is detected by detector system 104. The detected characteristics are correlated with particular information in a database of controller 106.

The detected characteristic of first splice mark 18 conveys approach of splice 16 and the end of first section 12. In one specific embodiment, the detected characteristic of first splice mark 18 further conveys whether second section 14 of abrasive product 102 has the correct abrasive characteristic for processing article 108. In one, more specific embodiment, if second section 14 of abrasive product 102 does not have the correct abrasive characteristic for processing article 108, the system, e.g., controller 106, provides a signal to prevent movement of abrasive product 102. In another, more specific embodiment, after the detection of first splice mark 12, a set of period of time or distance that has been passed is determined. In this specific embodiment, if second section 14 of abrasive product 102 has the correct abrasive characteristic for processing article 108, the system, e.g., controller 106, provides a signal to process article 108 with second section 14 of abrasive product 102. In one example of this embodiment, upon detection of first splice mark 18, controller 106 provides a signal to skip upcoming area of abrasive product 102, and after the detection of a period of time, controller 106 provides a signal to resume processing of article 108, so that splice area of abrasive product 102 is avoided for processing of article 108.

In an embodiment employing abrasive product 102 that includes first splice mark 18 adjacent to splice 16 and further includes at least one second splice mark 22 adjacent to splice 16, at least one characteristic of second splice mark 22 is detected. The detected characteristic of second splice mark 22 conveys the beginning of second section 14. In one specific embodiment, the detected characteristic of second splice mark 22 further conveys whether second section 14 of abrasive product 102 has the correct abrasive characteristic for processing article 108. In one, more specific embodiment, if second section 14 of abrasive product 102 does not have the correct abrasive characteristic for processing article 108, the system, e.g., controller 106, provides a signal to prevent movement of abrasive product 102. In another, more specific embodiment, if second section 14 of abrasive product 102 has the correct abrasive characteristic for article 108, the system, e.g., controller 106, provides a signal to process article 108 with second section 14 of abrasive product 102. In one example of this embodiment, upon detection of first splice mark 18, controller 106 provides a signal to skip upcoming area of abrasive product 102, and after the detection of second splice mark 22, controller 106 provides a signal to resume the processing of article 108, so that splice area of abrasive product 102 is avoided for the processing of article 108.

Abrasive product 102 that includes first splice mark 18 adjacent to splice 16 and/or second splice mark 18 adjacent to splice 16, optionally can further include at least one first section mark 20 and/or at least one second section mark 24. In one embodiment, at least one characteristic of first section mark 20 is detected. The detected characteristic of first section mark 20 conveys at least one piece of abrasive product information of first section 12, such as product type, grain size of abrasive grains, identification of abrasive side, width and index. In one specific embodiment, the detected characteristic of first section mark 20 further conveys whether first section 12 of abrasive product 102 has the correct abrasive characteristic for processing article 108. In one, more specific embodiment, if first section 12 of abrasive product 102 does not have the correct abrasive characteristic for processing article 108, the system, e.g., controller 106, provides a signal to prevent movement of abrasive product 102. In another, more specific embodiment, if first section 12 of abrasive product 102 has the correct abrasive characteristic for processing article 108, the system, e.g., controller 106, provides a signal to process article 108 with first section 12 of abrasive product 102.

In another specific embodiment, at least one characteristic of second section mark 24 is detected. The detected characteristic of second section mark 24 conveys at least one piece of abrasive product information of second section 12, such as product type, grain size of abrasive grains, identification of abrasive side, width and index. In one specific embodiment, the detected characteristic of second section mark 24 further conveys whether second section 14 of abrasive product 102 has the correct abrasive characteristic for processing article 108. In one, more specific embodiment, if second section 14 of abrasive product 102 does not have the correct abrasive characteristic for processing article 108, the system, e.g., controller 106, provides a signal to prevent movement of abrasive product 102. In another, more specific embodiment, if second section 14 of abrasive product 102 has the correct abrasive characteristic for processing article 108, the system, e.g., controller 106, provides a signal to process article 108 with second section 14 of abrasive product 102.

When abrasive product 102 employs both second splice mark 22 and second section mark 24, the characteristics of each mark can independently be detected, and each of the detected characteristic can independently convey at least one piece of abrasive product information of second section 12.

In some embodiments, abrasive product 102 employs a repeat of either first section mark 20, or second section mark 22, or both. In these embodiments, at least one characteristic of the repeat mark is detected. The detected characteristic of the repeat mark conveys at least one piece of abrasive product information, such as product type, grain size of abrasive grains, identification of abrasive side, width, index and rupture.

In the invention, the verification, e.g., determining whether or not first section 12 and/or second section 14 has the correct abrasive characteristic for processing article 108, can be performed while abrasive product 102 is static or in motion. In a specific embodiment, the verification is performed while abrasive product 102 is static and prior to the initiation of processing article 28 with abrasive product 102.

The degree of indexing of abrasive product 102 can also be measured by the information conveyed by at least one of the detected characteristics of the repeat mark. In one specific embodiment, the degree of indexing is measured by tracking the amount of abrasive product 102 traveled. The degree of indexing is measured with a count of marks of the repeat mark while the abrasive product 102 travels. Typically, the abrasive product 102 advances a fixed amount which is then recorded in the data base. With a known spacing between the marks and a known amount of abrasive product 102 to be pulled, it is then straightforward to compare the readings of the degree of indexing by detector 104 to a predetermined amount of indexing contained in the database.

The information conveyed by each of the detected characteristics of the repeat mark can also be employed to detect breakage or rupture of abrasive product 102 during processing of article 108. In one specific embodiment, system 100 employs first detector system 104 and second detector system 110, wherein first and second detector systems 104 and 110 are positioned before and after processing an area of article 108, respectively, as shown in FIG. 5. Breakage or rupture of abrasive product 102 at the process region is detected if first detector system 104 senses motion of abrasive product 102 (e.g., detection of marks is made periodically), while second detector system 110 does not detect such motion. Breakage or rupture of abrasive product 102 at the loading region is detected if first detector system 104 fails to sense any motion of abrasive product 102. In a more specific embodiment, failure of detection of motion of abrasive product can be made by the failure of detection of an incoming marks after a predetermined time period.

In another specific embodiment, detector system 104 and/or detector system 110 independently counts a number of marks of the repeat mark, such as by dividing the length of the roll of the strip of abrasive product by the spacing between marks (e.g., first section marks 20 or second section marks 24), or simply by counting detected marks to provide the number of marks. In a more specific embodiment, the counted number of marks is compared to a total number of marks of coated abrasive product 102 stored in the database of controller 106. This comparison provides information regarding the approach of the end of abrasive product 102, and arrival of the end of abrasive product 102 (e.g., the end and arrival of first section 12 or second section 14). In another more specific embodiment, controller 106 provides a warning signal of the end of abrasive product 102 after a predetermined number of marks of the repeat mark have been counted. In yet another more specific embodiment, the counting of the number of marks of the repeat mark preferably is performed at a predetermined speed, for example, every 30 seconds or every minute. Thus, the repeat mark is detected by limited observation of the abrasive product, whereby the abrasive product is observed at a frequency that coincides with presence of each repeat at a point of observation.

Each of marks 18, 20, 22 and 24, including a repeat of first or second section marks, can be machine or human discernable, or both machine and human discernable. Preferably, each of the marks is at least machine discernable. Any suitable detecting mechanism known in the art can be employed in the invention. Examples include optical, electrical, magnetic characterization systems known in the art. In one specific embodiment, an optical characterization system is employed. In one, more specific embodiment, the optical detector system includes a guiding system, a source of light behind the product, a sensor capable of identifying characteristics of each of the marks and/or a controller that performs image analysis.

In the invention, various types of markings can be employed. Suitable examples of the markings that can be employed in the invention include an oval, a circle, a rectangle, a square, a triangle, a diamond, a star, a polygon (including at least, e.g., a pentagon, a hexagon and an octagon) and any user-defined arbitrary shape. The markings suitable for use in the invention include protrusions, depressions, holes, voids, color or pigment variations, and magnetic or electric markings. Specific examples include a hole, a protrusion, a stripe print, a letter print (e.g. "A") or a number print (e.g., "3") is employed in the invention. More specific examples include a hole and a protrusion.

The mark(s) of the coated abrasive products of the invention can be made by any suitable method known in the art. For example, any suitable printing method known in the art can be used for making print types of the mark(s). Also, any cutting or embossing method known in the art, for example, a laser technique, can be used for making hole, embossment or protrusion types of the mark(s).

The coated abrasive products of the invention generally include abrasive grains, either in powder form or in agglomerate from of abrasive powders, and a binder over a substrate (or a base layer), and optionally further includes one or more coatings over the abrasive grains. As used herein, the term "coated abrasive product" encompasses a woven abrasive tool and a nonwoven abrasive tool. In one example, coated abrasive product 12 includes a substrate, which is optionally treated with a presize coat and a make coat overlaying the optional presize coat. The coated abrasive products can further include abrasive particles, or an agglomerate thereof is attached to the maker coat or the presize coat when it is employed. A size coat optionally can be applied over the abrasive particles or an agglomerate. A supersize coat optionally can also be included in the coated abrasive products. The inclusion of a backsize coat, presize coat, size coat, and/or supersize coat is dependent upon the abrasive product's specific applications.

Any suitable substrate material known in the art can be employed in the invention. The substrate useful in the invention can be rigid, but generally is flexible. Examples include paper, cloth, film, fiber, polymeric materials, nonwoven materials, vulcanized rubber or fiber, etc., or a combination of one or more of these materials, or treated versions thereof. The choice of the substrate material generally depends on the intended application of the coated abrasive product to be formed. As used herein, "nonwoven" means a web of random or directional fibers held together mechanically, chemically, or physically, or any combination of these. Examples of nonwoven materials include fibers formed into a nonwoven web that provides a three-dimensional integrated network structure. Any fibers known to be useful in nonwoven abrasive tools can be employed in the invention. Such fibers generally are formed from various polymers, including polyamides, polyesters, polypropylene, polyethylene and various copolymers thereof. Cotton, wool, blast fibers and various animal hairs can also be used for forming nonwoven fibers. In some applications, the nonwoven substrate can include a collection of loose fibers, to which abrasive powders or agglomerates are added to provide an abrasive web having abrasive powders or agglomerates throughout.

Suitable abrasive materials for use in the invention include diamond, corundum, emery, garnet, chert, quartz, sandstone, chalcedony, flint, quartzite, silica, feldspar, pumice and talc, boron carbide, cubic boron nitride, fused alumina, ceramic aluminum oxide, heat treated aluminum oxide, alumina zirconia, glass, silicon carbide, iron oxides, tantalum carbide, cerium oxide, tin oxide, titanium carbide, synthetic diamond, manganese dioxide, zirconium oxide, and silicon nitride. The abrasive materials can be oriented, or can be applied to the substrate without orientation (i.e., randomly), depending upon the particular desired properties of the coated abrasive tools. In choosing an appropriate abrasive material, characteristics, such as size, hardness, compatibility with workpieces and heat conductivity, are generally considered. Abrasive materials useful in the invention typically have a particle size ranging from about 0.1 micrometer and about 1,500 micrometers, such as from about 10 micrometers to about 1000 micrometers.

In some cases, a supersize coat is employed in an abrasive product of the invention. Generally, the function of a supersize coat is to place on a surface of coated abrasive materials an additive that provides special characteristics, such as enhanced grinding capability, surface lubrication, anti-static properties or anti-loading properties. Examples of suitable grinding aids include $KBF_4$ and calcium carbonate. Examples of suitable lubricants include lithium stearate and the like. Examples of suitable anti-static agent include alkali metal sulfonates, tertiary amines and the like. Examples of suitable anti-loading agents include metal salts of fatty acids, for example, zinc stearate, calcium stearate, lithium stearate, sodium laurel sulfate and the like. Anionic organic surfactants can also be used effective anti-loading agents. A variety of examples of such anionic surfactants and antiloading compositions including such an anionic surfactant are described in U.S. Patent Application Publication No. 2005/0085167 A1, the entire teachings of which are incorporated herein by reference. Other examples of suitable anti-loading agents include inorganic anti-loading agents, such as metal silicates, silicas, metal carbonates and metal sulfates. Examples of such inorganic anti-loading agents can be found in WO 02/062531, the entire teachings of which are incorporated herein by reference.

In the coated abrasive products of the invention, first section 12 and second section 14 can have the identical abrasive characteristics with each other. Alternatively, first section 12 and second section 14 can have at least one different characteristic from each other. The at least one different characteristic includes types of the abrasive grains, the substrate, the binder, the coating, and the number of the coatings. In one embodiment, first section 12 and second section 14 can be joined together continuously by splice 16, and respective mark(s) is made. In another embodiment, respective mark(s) of first and second sections 12 and 14 first, and then the two sections are joined together continuously by splice 16.

The abrasive coated products of the invention can be in any form, such as a roll or belt form. In a specific embodiment, the abrasive coated products are coated abrasive rolls, such as rolls of micro-finishing film, lapping film or finishing cloth. In another specific embodiment, the abrasive coated products, such as coated abrasive rolls, further include printed information at a surface opposite the surface that includes the mark(s) (e.g., first splice mark 18 and optionally first section mark 20, second splice mark 22 and/or second section mark 24). More preferably, abrasive grains are attached to the surface of mark(s) opposite the surface of the printed information. Examples of printed information includes a logo print of a manufacturer or grain size. The printed information can be in the form of a periodic repeat, or can be random. The additional printed information, such as a logo print, can be used for identifying the side that includes the abrasive grains.

Equivalents

While this invention has been particularly shown and described with references to example embodiments thereof, it will be understood by those skilled in the art that various changes in form and details may be made therein without departing from the scope of the invention encompassed by the appended claims.

What is claimed is:

1. A coated abrasive product, comprising:

a first section and a second section, the first and the second sections being continuously joined together by a splice, the first section including at least one first splice mark at a predefined location adjacent to the splice to denote the location of the splice, the second section including at least one second splice mark adjacent to the splice, wherein the first splice mark is a marking or a cluster of markings, wherein the second splice mark is a marking or a cluster of markings, wherein the first and the second splice marks have at least one characteristic different from each other, and wherein the marking or cluster of markings are not abrasive grains.

2. The coated abrasive product of claim 1, wherein the characteristic is selected from the group consisting of shape of the marking, dimension of the marking, color of the marking, distance of the mark from an edge along the length of the abrasive product, number of the markings, distance between the markings, and shape of the marking cluster.

3. The coated abrasive product of claim 1, wherein i) either the first section includes a plurality of the first splice marks across the width of the coated abrasive product, or the second section includes a plurality of the second splice marks across the width of the coated abrasive product, or ii) both the first section includes a plurality of the first splice marks across the width of the coated abrasive product, and the second section includes a plurality of the second splice marks across the width of the coated abrasive product.

4. The coated abrasive product of claim 3, wherein the characteristic is selected from the group consisting of number of the marks across the width of the coated abrasive product and the distance between the marks.

5. The coated abrasive product of claim 1, wherein each of the first section and the second section independently further includes abrasive grains and a binder over a substrate, and optionally further includes one or more coatings over the abrasive grains.

6. The coated abrasive product claim 5, wherein the first section and the second section are different from each other in at least one characteristic selected from the group consisting of the abrasive grains, the substrate, the binder, the coating and number of the coatings.

7. A coated abrasive product, comprising:

a first section and a second section, the first and the second sections being continuously joined together by a splice, the first section including at least one first splice mark at a predefined location adjacent to the splice to denote the location of the splice, the second section including at least one second splice mark adjacent to the splice, wherein the first splice mark is a marking or a cluster of markings, wherein the second splice mark is a marking or a cluster of markings, wherein the marking or cluster of markings are not abrasive grains, and wherein the first splice mark is a marking or a cluster of markings, wherein the second section further includes at least one second section mark at an area other than adjacent to the splice of the second section, the second section mark being a marking or a cluster of markings.

8. The coated abrasive product of claim 7, wherein the second section includes a repeat of the second section marks extending essentially throughout the length of the second section.

9. A coated abrasive product, comprising:

a first section and a second section, the first and the second sections being continuously joined together by a splice, the first section including at least one first splice mark at a predefined location adjacent to the splice to denote the location of the splice, the second section including at least one second splice mark adjacent to the splice, wherein the first splice mark is a marking or a cluster of markings, wherein the second splice mark is a marking or a cluster of markings, wherein the marking or cluster of markings are not abrasive grains, and wherein the second section further includes at least one second section mark, the second section mark being a marking or a cluster of markings, wherein the second section mark and the second splice mark have at least one characteristic different from each other, the characteristic being selected from the group consisting of shape of the marking, dimension of the marking, color of the marking, number of the markings, distance of the mark from an edge along the length of the abrasive product, distance between the markings, and shape of the marking cluster.

10. The coated abrasive product of claim 9, wherein the second section includes a repeat of the second section marks extending essentially throughout the length of the second section.

11. A coated abrasive product, comprising:

a first section and a second section, the first and the second sections being continuously joined together by a splice, the first section including at least one first splice mark at a predefined location adjacent to the splice to denote the location of the splice, wherein the marking or cluster of markings are not abrasive grains, and wherein the first section further includes at least one first section mark adjacent to the beginning of the first section, the first section mark being a marking or a cluster of markings.

12. The coated abrasive product of claim 11, wherein the first section mark shares at least one characteristic with at least one of the first splice mark and the second splice mark, the characteristic being selected from the group consisting of shape of the marking, dimension of the marking, color of the marking, number of the markings, distance of the mark from an edge along the length of the abrasive product, distance between the markings, and shape of the marking cluster.

13. The coated abrasive product of claim 11, wherein the first section mark and the first splice mark have at least one characteristic different from each other, the characteristic being selected from the group consisting of shape of the marking, dimension of the marking, color of the marking, number of the markings, distance of the mark from an edge along the length of the abrasive product, distance between the markings, and shape of the marking cluster.

14. The coated abrasive product of claim 11, wherein the first section includes a repeat of the first section marks extending essentially throughout the length of the first section.

15. The coated abrasive product of any one of claims 7, 9 and 11, wherein each marking independently is selected from the group consisting of a hole, a protrusion, a stripe print and a Jetter print.

16. The coated abrasive product of claim 15, wherein each marking independently is selected from the group consisting of a hole and a protrusion.

17. A method of processing an article with a coated abrasive product, comprising the steps of:

a) detecting at least one characteristic of at least one first splice mark of a first section of the abrasive product, wherein the abrasive product further includes a second section that is continuously joined together with the first section by a splice, and the first splice marks being placed at a predefined location adjacent to the splice to denote the location of the splice, the second section including at least one second splice mark adjacent to the splice, the first and second splice marks each being a marking or a cluster of markings that are not abrasive grains, wherein the first and the second splice marks have at least one characteristic different from each other;

b) comparing the detected characteristic to a database, wherein the detected characteristic of the first splice mark conveys approach of the splice and the end of the first section; and c) providing a signal to skip the splice to thereby prevent the article being processed with the splice area of the abrasive product.

18. The method of claim 17, wherein the detected characteristic of the first splice mark conveys whether the second section of the abrasive product has the correct abrasive characteristic for processing the article.

19. The method of claim 18, further including preventing movement of the abrasive product if the second section of the abrasive product does not have the correct abrasive characteristic for processing the article.

20. The method of claim 18, further including providing a signal to process the article with the second section of the abrasive product after a set of period of time or distance has been passed after the detection of the first splice mark, if the second section of the abrasive product has the correct abrasive characteristic for processing the article.

21. The method of claim 18, wherein the second section of the abrasive product includes at least one second splice mark adjacent to the splice, the second splice mark being a marking or a cluster of markings, and the method further includes detecting at least one characteristic of at least one characteristic of the second splice mark.

22. The method of claim 21, further including comparing the detected characteristic of the second splice mark to a database, wherein the detected characteristic of the second splice mark conveys the beginning of the second section.

23. The method of claim 22, wherein the first and the second splice marks have at least one characteristic different from each other.

24. The method of claim 23, wherein each of the detected characteristics independently is selected from the group consisting of shape of the marking, dimension of the marking, color of the marking, distance of the mark from an edge along the length of the abrasive product, number of the markings, distance between the markings, and shape of the marking cluster.

25. The method of claim 23, wherein i) either the first section includes a plurality of the first splice marks across the width of the coated abrasive product, or the second section includes a plurality of the second splice marks across the width of the coated abrasive product, or ii) both the first section includes a plurality of the first splice marks across the width of the coated abrasive product, and the second section includes a plurality of the second splice marks across the width of the coated abrasive product, and wherein each of the detected characteristics independently is selected from the group consisting of number of marks across the width of the coated abrasive product and the distance between marks.

26. The method of claim 23, wherein at least one of the detected characteristic of the second splice mark further conveys at least one piece of abrasive product information selected from the group consisting of product type of the second section, grain size of the second section, identification of abrasive side, width of the second section and index.

27. The method of claim 23, wherein at least one of the detected characteristic of the second splice mark conveys whether the second section of the abrasive product has the correct abrasive characteristic for processing the article.

28. The method of claim 27, further including preventing movement of the abrasive product of the second section of the abrasive product does not have the correct abrasive characteristic for processing the article.

29. The method of claim 23, wherein the second section of the abrasive product further includes at least one second section mark at an area other than adjacent to the splice of the second section, the second section mark being a marking or a cluster of markings, and wherein the detection of the second splice mark includes detecting at least one characteristic of the second splice mark.

30. The method of claim 29, wherein the detected characteristic of the second splice mark conveys at least one piece of abrasive product information selected from the group consisting of product type of the second section, grain size of the second section, identification of abrasive side, width of the second section, rupture and index.

31. The method of claim 22, wherein the second section further includes at least one second section mark, the second section mark being a marking or a cluster of markings, wherein the second section mark and the second splice mark have at least one characteristic different from each other, the characteristic being selected from the group consisting of shape of the marking, dimension of the marking, color of the marking, number of the markings, distance between the markings, and shape of the marking cluster, and wherein the method further includes detecting at least one characteristic of the second section mark of the second section.

32. The method of claim 31, wherein the detected characteristic of the second section mark conveys at least one piece of abrasive product information selected from the group consisting of product type of the second section, grain size of the second section, identification of abrasive side, width of the second section, rupture and index.

33. The method of claim 31, wherein the detected characteristic of the second section mark conveys whether the abrasive product is the correct abrasive product with which the article is to be processed.

34. The method of claim 33, further including preventing movement of the abrasive product if the abrasive product is not the correct abrasive product with which the article is to be processed.

35. The method of claim 31, wherein the second section of the abrasive product further includes a repeat of the second section marks extending essentially throughout the length of the second section, wherein the detection of the second section mark includes detecting at least one characteristic of the second section mark repeat.

36. The method of claim 35, wherein the detected characteristic of the second section mark repeat conveys at least one piece of abrasive product information selected from the group consisting of product type of the second section, grain size of the second section, identification of abrasive side, width of the second section, rupture and index.

37. The method of claim 22, wherein the first section of the abrasive product further includes at least one first section mark adjacent to the beginning of the first section, the first section mark being a marking or a cluster of markings, and wherein the method further includes detecting at least one characteristic of the first section mark.

38. The method of claim 37, wherein of the detected characteristic of the first section mark conveys at least one piece of abrasive product information selected from the group consisting of product type of the first section, grain size of the first section, identification of abrasive side, width of the first section and index.

39. The method of claim 37, wherein the detected characteristic of the first section mark conveys whether the abrasive product is the correct abrasive product with which the article is to be processed.

40. The method of claim 39, further including preventing movement of the abrasive product if the abrasive product is not the correct abrasive product with which the article is to be processed.

41. The method of claim 37, wherein the first section mark shares at least one characteristic with at least one of the first splice mark and the second splice mark, the characteristic being selected from the group consisting of shape of the marking, dimension of the marking, color of the marking, number of the markings, distance of the mark from an edge along the length of the abrasive product, distance between the markings, and shape of the marking cluster.

42. The method of claim 37, wherein the first section mark and the first splice mark have at least one characteristic different from each other, the characteristic being selected from the group consisting of shape of the marking, dimension of the marking, color of the marking, number of the markings, distance of the mark from an edge along the length of the abrasive product, distance between the markings, and shape of the marking cluster.

43. The method of claim 37, wherein the first section of the abrasive product includes a repeat of the first section marks extending essentially throughout the length of the first section, and wherein the detection of the first section mark includes detecting at least one characteristic of the first section mark repeat.

44. The method of claim 43, wherein of the detected characteristic of the first section mark repeat conveys at least one piece of abrasive product information selected from the group consisting of product type of the first section, grain size of the first section, identification of abrasive side, width of the first section, rupture and index.

45. A method of acquiring information of a coated abrasive product, comprising the steps of:

a) detecting at least one characteristic of at least one first splice mark of a first section of the abrasive product, wherein the abrasive product further includes a second section that is continuously joined together with the first section by a splice, and the first splice marks being placed at a predefined location adjacent to the splice to denote the location of the splice, the second section including at least one second splice mark adjacent to the splice, the first and second splice marks each being a marking or a cluster of markings that are not abrasive grains, wherein the first and the second splice marks have at least one characteristic different from each other; and b) comparing the detected characteristic to a database, wherein the detected characteristic of the first splice mark conveys approach of the splice and the end of the first section.

46. The method of claim 45, wherein the detected characteristic of the first splice mark conveys whether the second section of the abrasive product has the correct abrasive characteristic for processing the article.

47. The method of claim 46, further including detecting a set of period of time or distance has been passed after the detection of the first splice mark.

48. The method of claim 45, wherein the second section of the abrasive product includes at least one second splice mark adjacent to the splice, the second splice mark being a marking or a cluster of markings, and the method further includes detecting at least one characteristic of at least one characteristic of the second splice mark.

49. The method of claim 48, further including comparing the detected characteristic of the second splice mark to a database, wherein the detected characteristic of the second splice mark conveys the beginning of the second section.

50. A method of preparing a coated abrasive product, comprising forming a first section and a second section, the first and the second sections being continuously joined together by a splice, the first section including at least one first splice mark at a predefined location adjacent to the splice to denote the location of the splice, the first splice mark being a marking or a cluster of markings that are not abrasive grains, wherein the abrasive product further includes a second splice mark in the second section, adjacent to the splice, the second splice mark being a marking or a cluster of markings, and wherein the first and the second splice marks are formed to have at least one characteristic different from each other.

51. The method of claim 50, wherein each marking independently is selected from the group consisting of a hole, a protrusion, a stripe print and a letter print.

52. The method of claim 50, wherein each of the first section and the second section independently formed to further include abrasive grains and a binder over a substrate, and optionally to further include one or more coatings over the abrasive grains.

53. The method claim 52, wherein the first section and the second section are different from each other in at least one characteristic selected from the group consisting of the abrasive grains, the substrate, the binder, the coating and number of the coatings.

* * * * *